US006250931B1

(12) United States Patent
Mendelson

(10) Patent No.: US 6,250,931 B1
(45) Date of Patent: Jun. 26, 2001

(54) DETACHABLE POWER SUPPLY APPARATUS

(75) Inventor: Lewis A. Mendelson, Overland Park, KS (US)

(73) Assignee: Kinetic Group L.L.C., Davenport, IA (US)

( * ) Notice: Subject to any disclaimer, the term of this patent is extended or adjusted under 35 U.S.C. 154(b) by 0 days.

(21) Appl. No.: 09/432,849

(22) Filed: Nov. 2, 1999

(51) Int. Cl.[7] ..... H01R 11/30
(52) U.S. Cl. ..... 439/39; 439/38
(58) Field of Search ..... 439/39, 38, 40, 439/374, 680

(56) References Cited

U.S. PATENT DOCUMENTS

| | | | | |
|---|---|---|---|---|
| Re. 17,993 | * | 3/1931 | Denison | 337/383 |
| 2,170,287 | | 8/1939 | Kinnebrew | 439/39 |
| 2,223,359 | * | 12/1940 | Eisnga | 337/12 |
| 2,764,747 | | 9/1956 | Modrey | 439/39 |
| 2,830,166 | * | 4/1958 | Loomis | 219/441 |
| 2,856,489 | | 10/1958 | Bletz | 337/392 |
| 2,926,230 | | 2/1960 | Foster | 337/381 |
| 2,936,359 | | 5/1960 | Sheahan | 219/441 |
| 3,019,320 | | 1/1962 | Braski et al. | 337/368 |
| 3,025,374 | * | 3/1962 | Reingruger | 337/389 |
| 3,068,342 | | 12/1962 | Jepson et al. | 219/436 |
| 3,202,798 | * | 8/1965 | Morris | 337/389 |
| 3,218,434 | | 11/1965 | Lee et al. | 219/365 |
| 3,363,214 | | 1/1968 | Wright | 439/39 |
| 3,681,568 | | 8/1972 | Schaefer | 219/432 |
| 3,737,623 | * | 6/1973 | Vallone | 219/441 |
| 3,926,493 | | 12/1975 | Wakabayashi | 439/39 |
| 4,107,638 | * | 8/1978 | Hollweck | 337/131 |
| 4,356,385 | | 10/1982 | Stein et al. | 219/441 |
| 4,400,679 | * | 8/1983 | Snider | 337/382 |
| 4,633,238 | * | 12/1986 | Goessler et al. | 340/593 |
| 4,647,120 | | 3/1987 | Karabakakis | 439/39 |
| 4,695,816 | * | 9/1987 | Essig et al. | 337/394 |
| 4,754,253 | * | 6/1988 | Slack et al. | 337/392 |
| 4,764,129 | * | 8/1988 | Jones et al. | 439/677 |
| 5,420,398 | * | 5/1995 | Petri et al. | 219/505 |
| 5,462,452 | | 10/1995 | Devine | 439/505 |
| 5,627,507 | * | 5/1997 | Morbitzer et al. | 337/394 |
| 5,699,034 | * | 12/1997 | Tsao | 337/394 |
| 5,873,737 | * | 2/1999 | Hashizawa et al. | 439/39 |

FOREIGN PATENT DOCUMENTS

| | | |
|---|---|---|
| 578642 | 3/1924 | (FR) . |
| 579341 | 3/1924 | (FR) . |

* cited by examiner

*Primary Examiner*—Gary Paumen
*Assistant Examiner*—Ross Gushi
(74) *Attorney, Agent, or Firm*—Shughart Thomson & Kilroy P.C.

(57) ABSTRACT

A detachable power supply apparatus for use with electrical appliances including removable temperature control devices includes a mounting panel on the temperature control device to which an electrical connector on a power supply cord is magnetically and electrically coupled. The mounting panel includes a ferrous contact plate attached to an outer surface thereof between a pair of conductive pins. The power supply cord includes a female electrical receptacle with a magnet subassembly attached at or near an outer surface thereof. The receptacle may be removably coupled to the mounting panel by positioning the receptacle outer surface adjacent the mounting panel contact plate. The magnet subassembly is designed to allow the receptacle to withstand a preselected tensile or pulling force and a preselected shearing or lateral force.

7 Claims, 2 Drawing Sheets

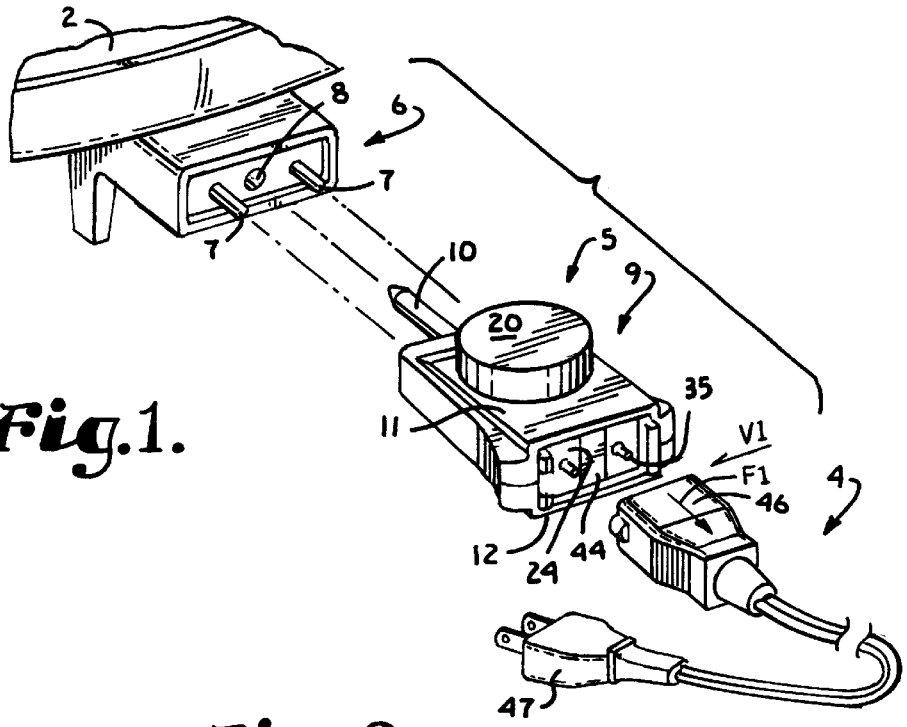
Fig.1.
Fig.2.
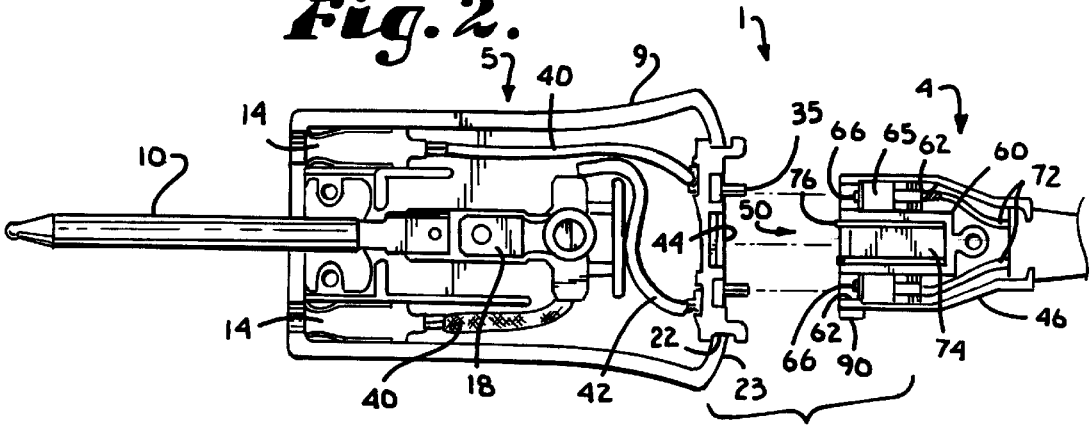

DETACHABLE POWER SUPPLY APPARATUS

BACKGROUND OF THE INVENTION

1. Field of the Invention

This invention is directed in general to a detachable power supply apparatus for use with temperature probes, electrical appliances such as frypans, deep fat fryers, cookers and the like, and in particular to a magnetically attachable "breakaway" power supply apparatus.

2. Description of the Related Art

Detachable power supply devices are well-known. For example, detachable temperature probes with a power supply cord fixedly attached thereto have long been used with a variety of electrical appliances including cookers, fryers, skillets, fondues, woks, corn poppers and the like. Conventional detachable temperature probes typically include a central control housing with a temperature probe extending therefrom, and a power supply cord fastened to and extending from an opposite end thereof. U.S. Pat. Nos. 2,856,489, 2,926,230, and 3,019,320 all disclose detachable thermostatic control devices including a male probe which can be removably attached to an electrical appliance by insertion into a female receiver thereof. The primary advantage of such devices is the ability to separate the probe from the appliance, allowing the appliance to be fully immersed in water for cleaning.

Detachable temperature probes require that continuous, intimate contact be maintained between the male temperature probe and the appliance's female receiver to accurately control the appliance's working temperature. For example, current Underwriters Laboratories, Inc.® ("UL") STANDARDS 1083 (33.1)and(33.2) require that a detachable temperature probe attached to an appliance be capable of withstanding a separation force of 35 lbf. (156 N) at any angle for one minute.

The desire for maintaining intimate contact between an appliance and its temperature probe has compromised safety. Each year a substantial number of accidents occur, for example when a small child inadvertently trips over the probe's power cord and overturns the appliance. Such accidents can result in serious injury, particularly when the appliance contains hot oil, boiling water, or the like. Further, studies have shown that a many of these accidents occur when the probe's power cord is extended and kicked or pulled at a ninety-degree angle (90°) thereto (e.g. from the side). Of course, these accidents could be prevented or reduced if, upon being kicked or pulled, the power cord became separated from the probe without disturbing the appliance.

A need exists to provide a safe, convenient, reliable detachable power supply apparatus for use with appliances, and particularly for use with temperature probes and the like.

SUMMARY OF THE INVENTION

The present invention generally comprises a detachable power supply apparatus for use with an appliance. The apparatus includes a mounting panel which can be attached, for example, to the appliance's sidewall or handle, or to the rear end of a temperature probe or the like. The mounting panel includes a ferrous contact plate attached to an outer surface thereof. A power supply device includes a socket plug with a magnet subassembly attached at or near an outer surface thereof. The plug may be removably coupled to the mounting panel by positioning the plug outer surface adjacent the mounting panel's contact plate. The magnet subassembly is designed to allow the plug to withstand a predetermined or preselected pulling force and a predetermined or preselected shearing or lateral force.

OBJECTS AND ADVENTAGES OF THE INVENTION

The principal objects and advantages of the present invention include: providing an improved detachable power supply apparatus; providing such an apparatus which can be readily attached to and detached from an electric appliance or a temperature probe; providing such an apparatus which allows the temperature probe to maintain intimate contact with the appliance to accurately and reliably control the appliance's temperature; providing such an apparatus with a power supply plug which can be magnetically coupled to the probe or appliance; providing such an apparatus which increases safe operation of the appliance by allowing the plug to be detached from the probe by the application of a predetermined or preselected lateral or shear force; providing such an apparatus which requires a predetermined or preselected pulling or tensile force to separate the power supply device from the temperature probe; providing such an apparatus that can be varied to accommodate a variety of appliance input power requirements; providing such an apparatus which meets or exceeds UL STANDARDS and applicable federal, state, and local regulations; providing such an apparatus which allows the temperature probes and appliances to meet or exceed UL STANDARDS and applicable federal, state, and local regulations; and providing such an apparatus which is particularly well-suited to its intended purpose.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 1 is an exploded and fragmentary perspective view of a detachable power supply apparatus removably attached to a temperature probe which in turn is removably attached to a temperature probe which in turn is removably attached to an appliance.

FIG. 2 is an exploded, enlarged and fragmentary top plan view of the probe of FIG. 1 with a top thereof removed, and a top sectional view of a receptacle plug of the apparatus with a top thereof removed.

DETAILED DESCRIPTION OF THE INVENTION

Figure 4:
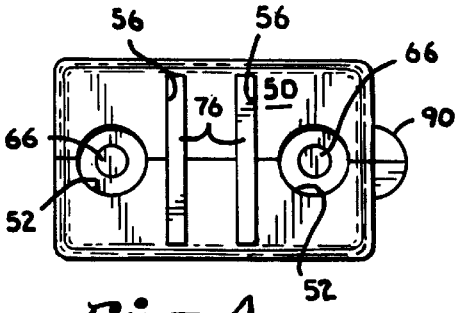
FIG. 4 is an enlarged elevational view of an outer face of the receptacle plug.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Although the present invention as shown in the embodiment in FIGS. 1 and 2 includes a temperature probe and an electrical appliance, as discussed below it is foreseen that the present invention can be used in a variety of applications involving electrical appliances, with or without temperature probes, where it would be advantageous to provide a quick-disconnect power supply apparatus.

Referring to the drawings, the reference numeral 1 refers to a detachable power supply apparatus embodying the present invention. The apparatus 1 is used in connection with an electrical appliance 2 and includes a power supply device or cord 4 and a temperature control device 5. The temperature control device 5 is adapted to be connected to a power input connector 6 on the appliance 2. The power input connector 6 includes power supply prongs 7 and a probe receiver 8. The temperature control device 5 includes a supportive housing or casing 9, and a male temperature probe 10 extending outward from a front end of the casing 9.

As used herein and with reference to FIG. 2, the front of the temperature control device 5 and the power supply cord 4 are on the left side of the drawing for each item as oriented in FIG. 2. Similarly the rear of the temperature control device 5 and the power supply cord 4 are on the right side of the drawing for each item as oriented in FIG. 2. In other words, the rear of the temperature control device 5 generally comprises the side of the temperature control device 5 positioned furthest away from the appliance 2 when connected thereto.

The housing 9 of the temperature control device includes top and bottom panels 11 and 12, joined together by any convenient manner such as screws (not shown). As shown in FIG. 2, a pair of conductive female receivers 14 which form an output power supply are located within the housing 9 at a front portion thereof. The female receivers 14 are adapted to receive the power supply prongs 7 to electrically connect the temperature control device 5 to the power input connector 6 on the appliance 2. When the temperature control device 5 is connected to the power input connector 6, the male temperature probe 10 extends into the probe receiver 8. A bi-metallic thermostat 18 is secured within the housing 9, and cooperates with the temperature probe 10 to regulate the appliance's 2 working temperature. As shown in FIG. 1, a thermostat control dial 20 located on the top of the housing 9 allows a user to adjust the temperature of the appliance 2 upward or downward. The temperature control device 5 is removably secured to the appliance 2 to permit total immersion washing of the appliance 2 without damaging the temperature control device 5.

A rectangular opening or receptacle 22 is formed in a rear wall 23 of the casing 9. As shown in FIGS. 1 and 2, a generally rectangular, plug connection panel or mounting panel 24 is secured in and extends across the opening 22 in the rear wall 23 of the casing 9. The plug connection panel 24 is positioned rearward of the temperature control device dial 20 and on a side of the dial 20 opposite the probe 10.

Figure 5:
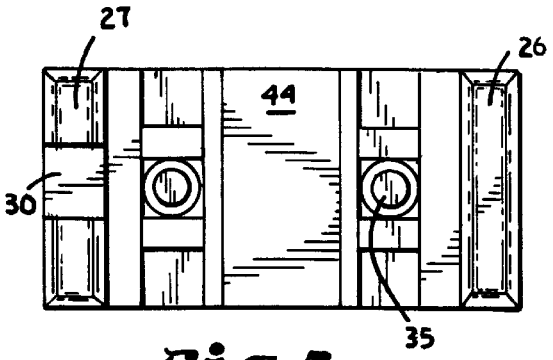
FIG. 5 is an enlarged elevational view of an outer face of the plug connection panel.
Figure 3:
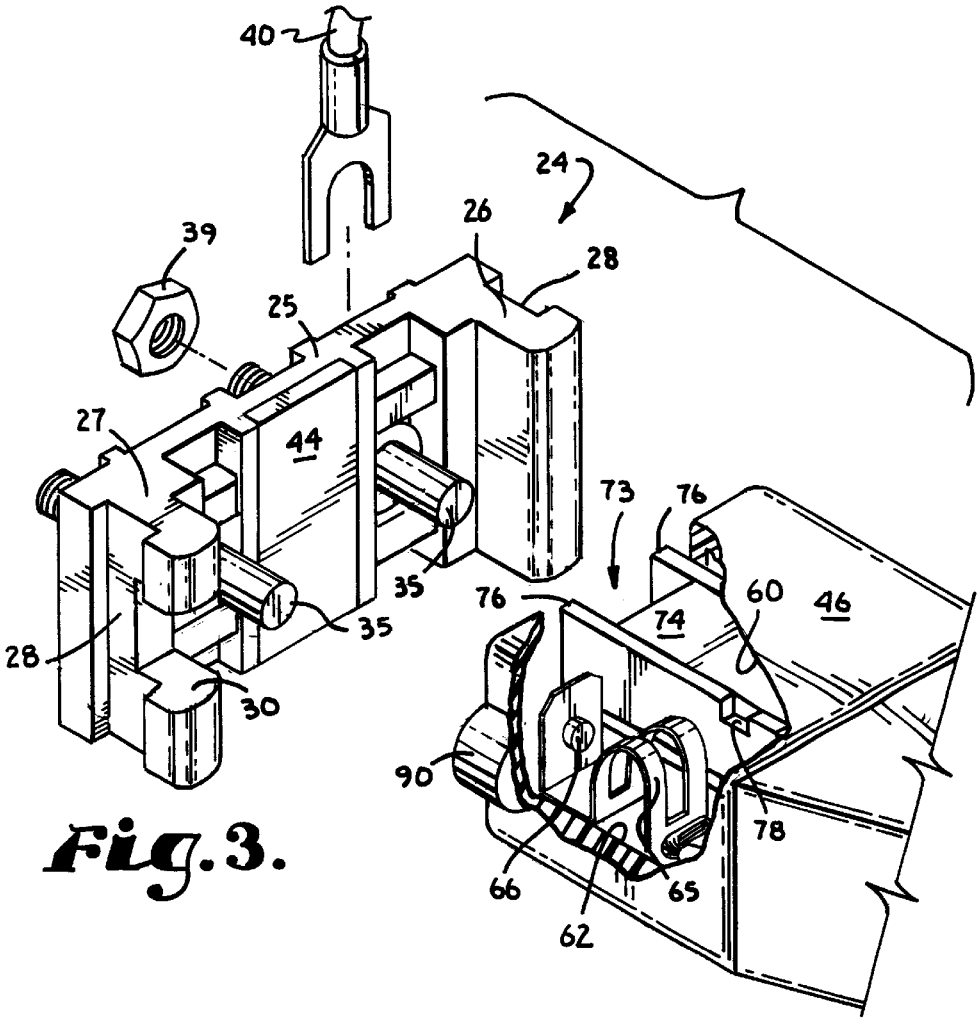
FIG. 3 is an enlarged, exploded, fragmentary perspective view of a plug connection panel and a receptacle plug with portions broken away to show internal details.

As shown in FIGS. 3 and 5, the plug connection panel 24 includes a central wall 25 with a pair of sidewalls 26 and 27 formed on opposite ends of the central wall 25 and generally extending rearward therefrom. Vertically extending grooves 28 are formed in an outer surface of each sidewall 26 and 27. The grooves 28 are spaced slightly rearward of the central wall 25. When the housing 9 is assembled, the plug connection panel 24 is positioned between the top and bottom panels 11 and 12 such that the edges of the rear wall 23 of the housing extend into the grooves 28 in the plug connection panel side walls 26 and 27 to hold the plug connection panel 24 in place. The location of the grooves 28 in the sidewalls 26 and 27 spaces the plug connection panel central wall 25 inward relative to a rear edge of the housing 9 such that the plug connection panel central wall 25 is recessed in the housing 9. As shown in FIG. 3, a semi-circular notch 30, the purpose of which is discussed below, is formed in sidewall 27.

As shown in FIGS. 3 and 5, a pair of conductive pins or prongs 35 extend through the central wall 25 of the plug connection panel 24 and are secured via nuts 39. As shown in FIG. 2, the pins 35 are connected by conductive wires 40 to the output power supply female receivers 14. Conductive wire 42 also supplies power to the probe 10.

As shown in FIGS. 3 and 5, a ferrous attachment plate 44 is attached to a rear or outer surface of the central wall 25 of the panel 24 intermediate pins 35. The outer surface of the contact plate 44 is generally rectangular, and presents a relatively large surface area which is recessed with respect to outer ends of the pins 35.

As shown in FIG. 1, the power supply cord 4 includes a female electrical receptacle 46 at one end and a plug or male electrical connector 47 at an opposite end. As shown in FIG. 4, a face or front end 50 of the receptacle 46 includes a pair of circular holes 52 and a pair of elongate slits 56 extending therethrough. Referring to FIGS. 2 and 3, a central chamber 60, and a pair of side channels 62 are formed within the receptacle 46.

As best seen in FIGS. 2 and 3, conductive contact springs 65, each having a conductive contact 66 formed on a front end thereof are secured within the side channels 62 in the receptacle 46. The contact springs 65 are electrically connected to polarized wires 72 of the power supply cord 4. The contacts 66 are centrally aligned with the holes 52 in the face 50 of the receptacle for engagement by the pins 35 of the plug connection panel 24.

As shown in FIGS. 2 and 3, a magnet assembly 73 comprising a block-type magnet 74 sandwiched between a pair of relatively flat, elongate, magnetically conductive plates 76 is mounted within the chamber 60. The magnet 74 magnetizes the plates 76. Each plate 76 includes a plate outer end which extends through one of the slits 56 and protrudes slightly beyond the face or front end 50 of the receptacle 46. The plates 76 are secured in place within the central chamber 60 of the receptacle 46 by any suitable means. For example, and as best seen in FIG. 3, each plate 76 may have a notch 78 formed in upper and lower surfaces thereof adapted to be engaged by projections or bosses (not shown) extending into the chamber 60 to prevent the plates 76 from sliding through the slits 56. The receptacle 46 also includes a boss or key 90 protruding from a side of the receptacle 46 proximate the front end thereof.

The power supply cord 4 is coupled to the temperature control device by advancing the female electrical receptacle 46 over the pins 35 in the plug connection panel 24 such that the pins 35 extend into the holes 52 of the receptacle 46. To attach the receptacle 46 to the plug connection panel 24, the receptacle must be oriented such that the key 90 on the receptacle 46 is aligned with the notch 30 in the sidewall 27 of the plug connection panel 24. When the holes 52 in receptacle 46 are aligned with pins 35 in panel 24, the magnet assembly 73 in the receptacle 46 is aligned with the ferrous contact plate 44 of the plug connection panel 24. As the receptacle 46 is advanced toward the panel 24 a magnetic couple is formed between the plug connection panel contact plate 44 and the magnetically conductive plates 76 extending forward and outward from the receptacle 46.

The orientation of the elongate plates 76 with respect to the rectangular contact plate 44 creates a magnetic coupling which can withstand a predetermined or preselected tensile force F1 and a predetermined or preselected shear force V1 to free the plug 46 from the housing 6 (see FIG. 1 for force vectors).

The pins 35 are longer that the distance from the front face 50 of the receptacle 46 through the holes 52 to the contacts 66 on the contact springs 65. When the receptacle 46 is coupled to the plug connection panel 24, the pins 35 bias the contacts 66 rearward. The diameter of the holes 52 is also considerably larger than the diameter of the pins 35 and the pins 35 are not frictionally engaged within the holes 52 as with conventional plugs. Instead, the magnetic coupling described above secures the receptacle 46 to the plug connection panel 24 with the desired release characteristics. The holes 52 are sized to allow the receptacle 46 to pivot or rock from side to side about the pins 35 in response to a shearing or lateral force to permit uncoupling of the receptacle 46 without additional frictional resistance or damage to the pins 35. The holes 52 may also be beveled to facilitate pivoting or rocking of the pins 35 within the holes 52. The inner edges of the sidewalls 26 and 27 and upper and lower inner edges of the temperature control device housing 9 along the opening 22 function as fulcrums against which the receptacle 46 may pivot upon the application of a shear force to the cord 4 to facilitate release of the power supply cord 4 from the temperature control device.

It is foreseen that attributes of the plug magnet assembly 74 can be changed to alter magnetic forces associated therewith. For example, magnets of varying sizes, shapes and strengths, and plates of different sizes and shapes can be utilized depending on the desired application. As a further example, a single magnet could be coupled directly to the contact plate 44, without the use of any magnetically conductive plates 76 to provide increased resistance to both a shear force V1 and to a tensile force F1. Other configurations of magnet(s) and/or plate(s) can be similarly employed.

It is also foreseen that the magnetic forces between the plate 44 and the assembly 73 could be reversed. In other words, the plate 44 may be magnetized with the assembly 73 being ferrous. Of course, the overall function of the coupling of the plate and the assembly 73 would be the same in either case.

It is to be understood that while certain forms of the present invention have been illustrated and described herein, it is not to be limited to the specific forms or arrangement of parts described and shown.

What is claimed and desired to be secured by Letters Patent is as follows:

1. A detachable power supply apparatus for an appliance, comprising:

a) a temperature control device removably and electrically connectable at a first end to said appliance; said temperature control device having a pair of conductive pins extending outward therefrom with a ferrous contact plate mounted on said temperature control device and extending between said pins; and b) a power supply cord having a male electrical connector at a first end and a female electrical connector at a second end; said female electrical connector having a pair of pin receiving holes formed in a front end thereof and a pair of electrical contacts mounted within said female electrical connector in alignment with said pin receiving holes and electrically connected to said male electrical connector; said female electrical connector further having a magnetized member extending outward from a front end thereof between said pin receiving holes and positioned to removably and magnetically couple with said ferrous contact plate on said temperature control device when said female electrical connector is positioned such that said pins on said temperature control device extend into said pin receiving holes in said female electrical connector to form a removable electrical connection between said conducting pins on said temperature control device and said electrical contacts in said female electrical connector.

2. The detachable power supply apparatus as in claim 1 wherein said magnetized member comprises a pair of magnetically conductive plates magnetically coupled to a magnet positioned within said female electrical connector and the strength of the magnet is selected to facilitate uncoupling of the female electrical connector from the temperature control device upon application of a preselected force to the female electrical connector relative to the temperature control device.

3. The detachable power supply apparatus as in claim 1 wherein said pin receiving holes are wider than said pins such that said pins can pivot within said pin receiving holes.

4. The detachable power supply apparatus as in claim 1 wherein said pins are recessed within a housing of said temperature control device.

5. The detachable power supply apparatus as in claim 1 wherein a key is formed on and protrudes from one side of said female electrical connector and said pins are positioned on said temperature control device between a pair of sidewalls one of which has a key receiving notch formed therein; said female electrical connector being connectable to said temperature control device only when said female electrical connector is oriented such that said key extends into said key receiving groove.

6. A detachable power supply apparatus for an appliance, comprising:

a) a temperature control device with first and second ends; said temperature control device removably and electrically connectable at said first end to said appliance; a ferrous, electrically conductive contact plate mounted to said temperature control device second end;

b) a power supply cord having an electrical connector with an outer face; a magnetized member attached to said connector outer face; and c) said power supply cord electrically, magnetically and removably coupled to said temperature control device when said connector is positioned adjacent said contact plate such that a magnetic couple is formed between the power supply cord magnetized member and the temperature control device contact plate.

7. A detachable power supply apparatus for an appliance, comprising:

a) a temperature control device removably and electrically connectable to said appliance, said temperature control device having a first electrically conductive element connected to a mounting panel thereof;

b) a power supply cord having a second electrically conductive element connected to an outer face thereof;

c) a magnetized member attached to one of the temperature control device mounting panel or the electrical connector outer face, and a ferrous contact attached to the other of the temperature control device mounting panel or the electrical connector outer face for removably magnetically and electrically coupling the power supply cord to the temperature control device.

* * * * *